US008894150B2

(12) United States Patent
Piretti

(10) Patent No.: US 8,894,150 B2
(45) Date of Patent: Nov. 25, 2014

(54) CHAIR WITH TILTING BACKREST

(75) Inventor: Giancarlo Piretti, Bologna (IT)

(73) Assignee: Pro-Cord S.p.A. (IT)

( * ) Notice: Subject to any disclaimer, the term of this patent is extended or adjusted under 35 U.S.C. 154(b) by 243 days.

(21) Appl. No.: 13/457,353

(22) Filed: Apr. 26, 2012

(65) Prior Publication Data

US 2012/0274111 A1 Nov. 1, 2012

(30) Foreign Application Priority Data

Apr. 29, 2011 (IT) ..... TO2011A0375

(51) Int. Cl.
*A47C 1/024* (2006.01)
*A47C 7/44* (2006.01)

(52) U.S. Cl.
CPC ..... *A47C 7/443* (2013.01)
USPC ..... 297/301.4; 297/301.1

(58) Field of Classification Search
USPC ..... 297/300.1, 300.2, 300.5, 301.1, 301.4
See application file for complete search history.

(56) References Cited

U.S. PATENT DOCUMENTS 2,018,825 A * 10/1935 Wood ..... 297/301.4
2,307,621 A * 1/1943 Dorton ..... 297/367 R
2,430,604 A 11/1947 Dorton
4,157,203 A * 6/1979 Ambasz ..... 297/300.5
4,165,900 A * 8/1979 Pesiri ..... 297/301.4
5,511,852 A * 4/1996 Kusiak et al. ..... 297/301.4
7,118,177 B2 * 10/2006 Piretti ..... 297/296
7,147,286 B2 * 12/2006 Cesaroni et al. ..... 297/301.1
7,686,395 B2 * 3/2010 Piretti ..... 297/297
8,282,166 B2 * 10/2012 Piretti ..... 297/294

FOREIGN PATENT DOCUMENTS

DE 1779141 A1 9/1971
EP 1557115 A1 7/2005
EP 2183997 A1 5/2010

OTHER PUBLICATIONS

Italian search report for application No. T020110375 dated Dec. 6, 2011.

* cited by examiner

*Primary Examiner* — Philip Gabler
(74) *Attorney, Agent, or Firm* — Patterson & Sheridan, LLP

(57) ABSTRACT

Chair comprising, a base structure bearing a seat, a tilting backrest, and at least one joint which connects the backrest to the base structure and allows a movement of the backrest between a rest position and a backward tilted position under a backwards push applied by the user, wherein said joint comprises a first and a second curved component with a circular profile coupled together in a telescopic manner and fixed to the base structure or to the seat and, respectively, to the backrest.

12 Claims, 16 Drawing Sheets

CHAIR WITH TILTING BACKREST

CROSS-REFERENCE TO RELATED APPLICATIONS

This application claims benefit of Italian patent application number TO2011A000375, filed Apr. 29, 2011, which is herein incorporated by reference.

BACKGROUND OF THE INVENTION

1. Field of the Invention

The present invention refers to a chair with a tilting backrest.

More precisely, the invention refers to a chair comprising a base structure bearing a seat, and a backrest connected to the base structure by means of two side joints that allow a movement of the backrest between a rest position and a backward tilted position under a backwards push applied by the user.

2. Description of the Related Art

In the state of the art, several solutions are known for obtaining a backward tilting movement of the backrest under a backwards push applied by the user.

For example, the document EP-A-1557115 by the same applicant describes a chair with a tilting backrest connected to the base structure by means of elastically yieldable side connecting components to allow backward tilting of the backrest.

Another known solution is described in document EP-A-2183997, in which the backrest is connected to the base structure by means of two elastic devices, each of which is formed by an elastic component, deformable by bending, and inserted within a plurality of stacked sectors.

One of the problems of the known solutions is that the centre of rotation of the backrest during the backward tilting movement does not coincide with the centre of rotation of the user's back. This means that during the backward tilting movement of the backrest there is a relative movement between the base surface of the backrest and the user's back. This relative movement tends to cause pulling-out of clothes.

For example, if the user is wearing a shirt tucked into his trousers, in the known chair types, the backward tilting movement of the backrest tends to pull out the shirt from his trousers.

SUMMARY OF THE INVENTION

The present invention aims to provide a chair with tilting backrest equipped with a simple and economical tilting mechanism of the backrest and allows the above drawback to be overcome.

According to the present invention, this object is achieved by a chair having the characteristics forming the subject of Claim 1.

The claims form an integral part of the teaching administered in relation to the invention.

BRIEF DESCRIPTION OF THE DRAWINGS

The present invention will now be described in detail with reference to the accompanying drawings, provided purely by way of a non-limiting example, wherein.

DETAILED DESCRIPTION

Figure 1:
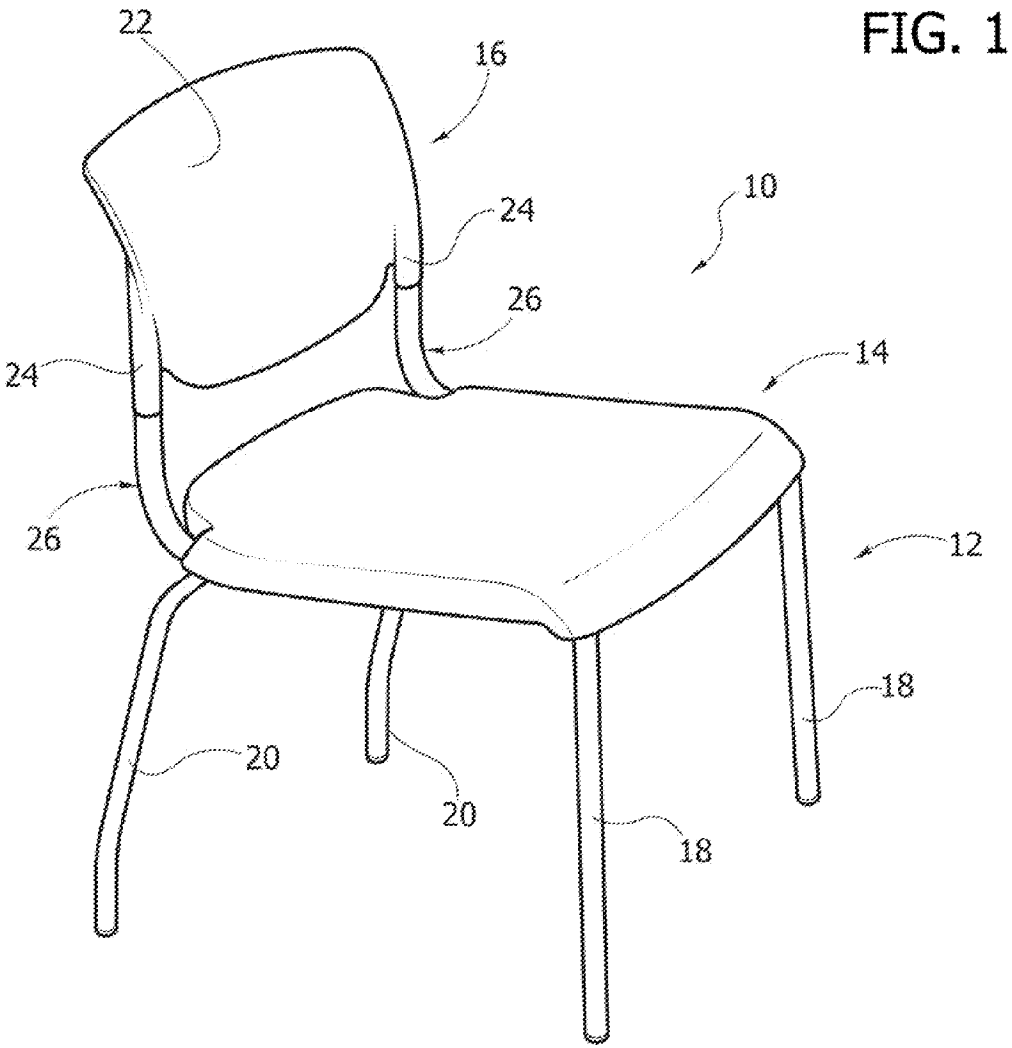
FIG. 1 is a perspective view of a chair according to the present invention.
Figure 2:
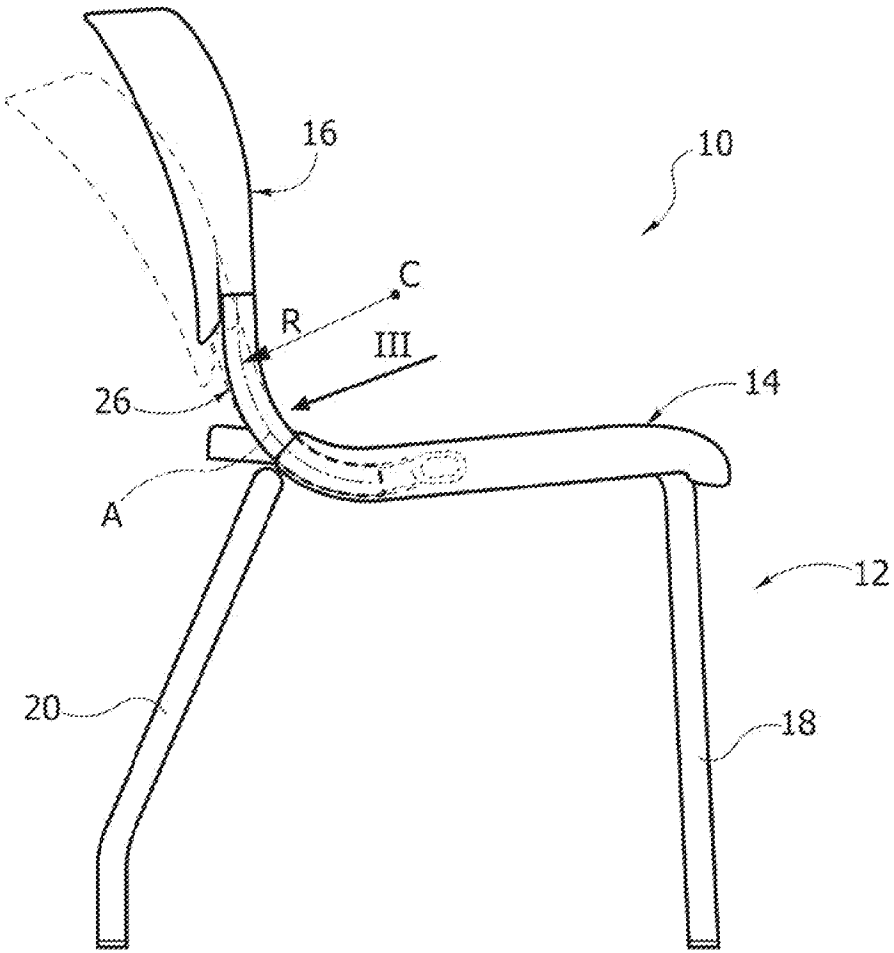
FIG. 2 is a side view of the chair of FIG. 1.

With reference to FIGS. 1 and 2, number 10 designates a chair comprising a base structure 12, a seat 14 and a tilting backrest 16. In the illustrated example, the base structure 12 comprises two front legs 18 and two rear legs 20, connected to one another by longitudinal and transverse components (not visible in the figures). The present invention is not limited to chairs with this type of base structure. The invention could also be used on office chairs in which the base structure comprises an upper component rotatable about a vertical axis and carrying the seat and backrest. In the illustrated example the seat 14 is formed by a shaped component of plastic material fixed to the longitudinal and transverse components of the base structure 12. Even this conformation of the seat 12 is not mandatory and may be subject to numerous variations.

The backrest 16 comprises a supporting surface 22 and two side uprights 24. In the embodiment illustrated by way of example in the Figures the supporting surface 22 and the side uprights 24 of the backrest 16 are formed in a single piece of injection-molded plastic material. However, many other solutions are possible within the scope of the present invention.

The backrest 16 is connected to the base structure 12 by means of two side joints 26 which allow a movement of the backrest 16 between a position of rest illustrated in FIG. 2 with a continuous line, and a backward tilted position as illustrated in FIG. 2 with a dotted line. The backrest 16 moves from the rest position to the backward tilted position under a backwards push applied by the user's back. The return from the tilted position back to the rest position takes place by effect of elastic means integrated into the side joints 26, as will be described below.

With reference to FIGS. 3-6, each side joint 26 comprises a first and a second curved component 28, 30 coupled together in a telescopic manner. The two curved components 28, 30 have a common longitudinal axis A in the form of an arc of a circle with a radius of curvature R. The centre C of the radius of curvature R defines the centre of oscillation of the backrest 16.

The first curved component 28 is equipped at one end by an attachment portion 31 by means of which it is fixed to the base structure 12. The second curved component 30 is fixed to the lower end of a corresponding side frame 24 of the backrest 16. The telescopic coupling between the two curved components 28, 30 enables the second curved component 30 to move with respect to the first curved component 28 on a curved path along the common longitudinal curved axis A.

With reference to FIG. 2, the centre of rotation C of the side joints 26 is essentially positioned in correspondence to the pelvis of the user. Therefore, the centre of rotation of the backrest 16 during the backward tilting movement essentially coincides with the centre of rotation of the user's back.

Thanks to this characteristic, the movement of backward tilting of the backrest essentially happens without relative movement between the supporting surface 22 of the backrest 16 and the back of the user. It thus avoids the effects of pulling-out of garments that occur with some solutions of tilting backrests according to the prior art.

Figure 3:
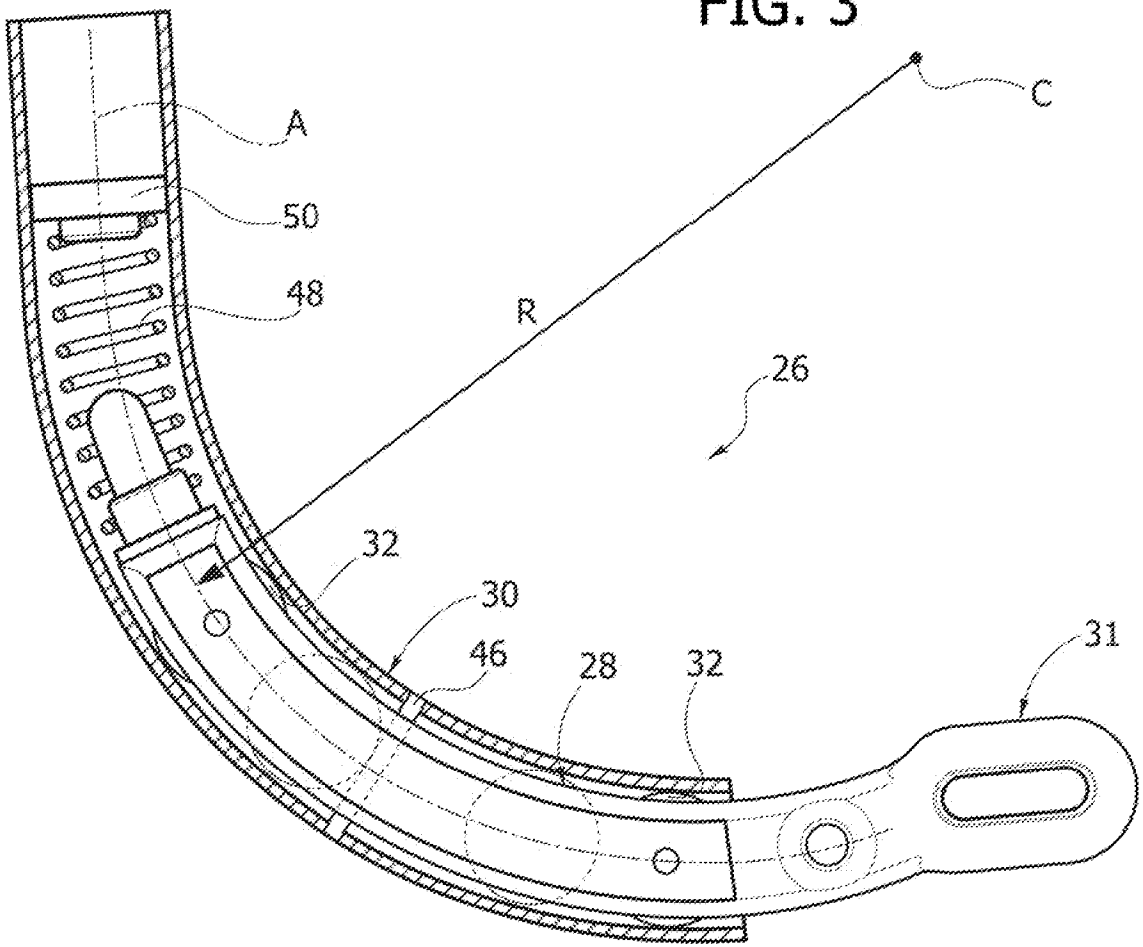
FIGS. 3 and 4 are axial sections of the oscillation joint of the backrest indicated by the arrow III in FIG. 2, respectively in the rest position and in the position of maximum backward tilting.
Figure 4:
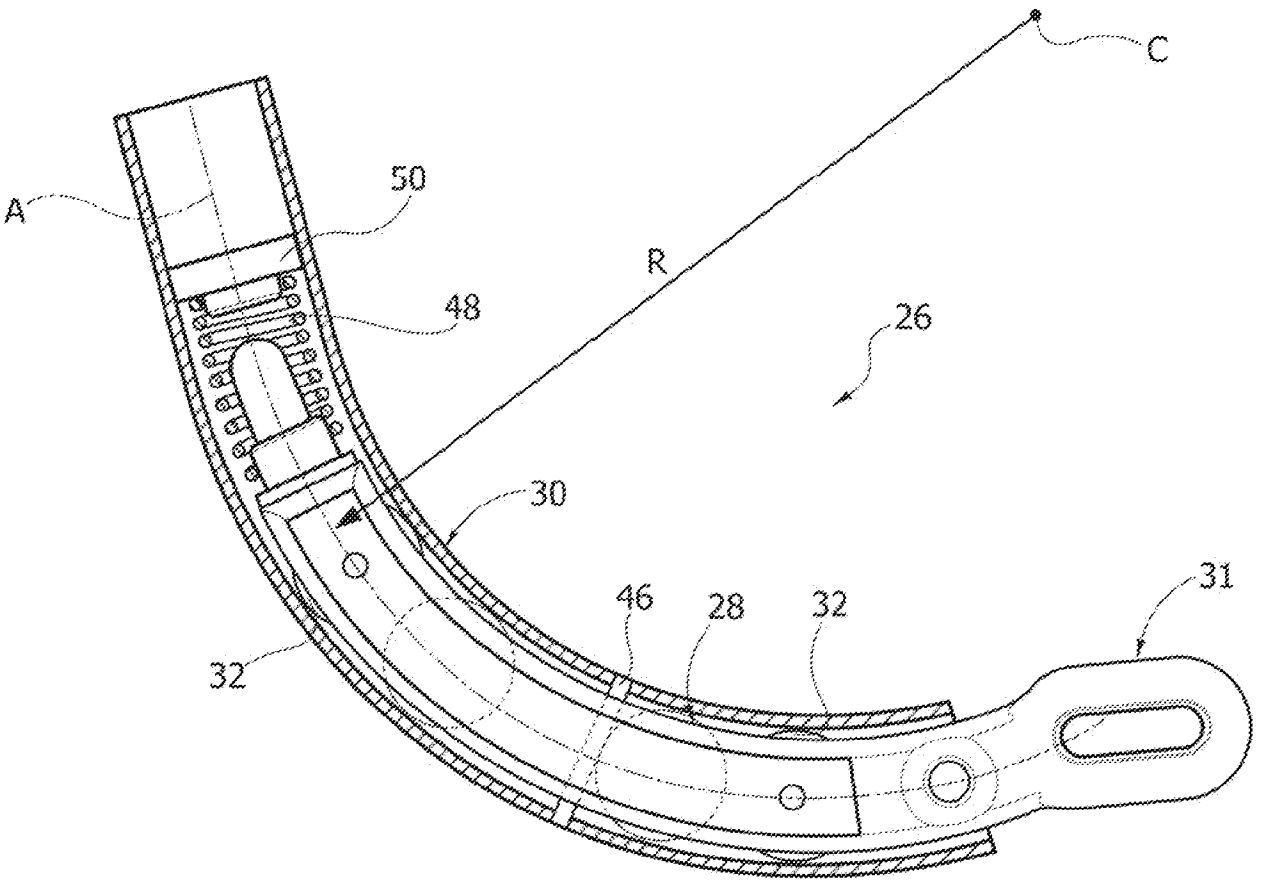
Figure 5:
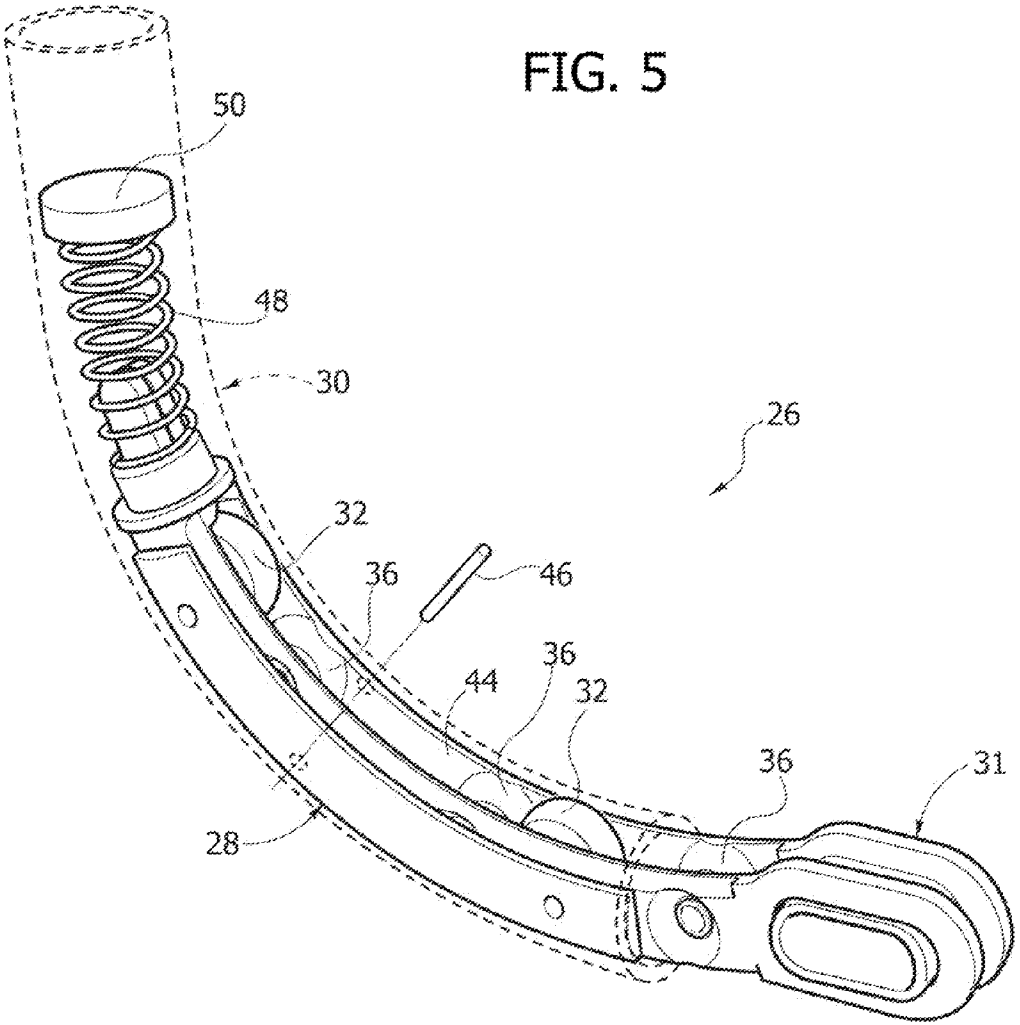
FIG. 5 is a perspective view in transparency of the oscillation joint of FIGS. 3 and 4.
Figure 6:
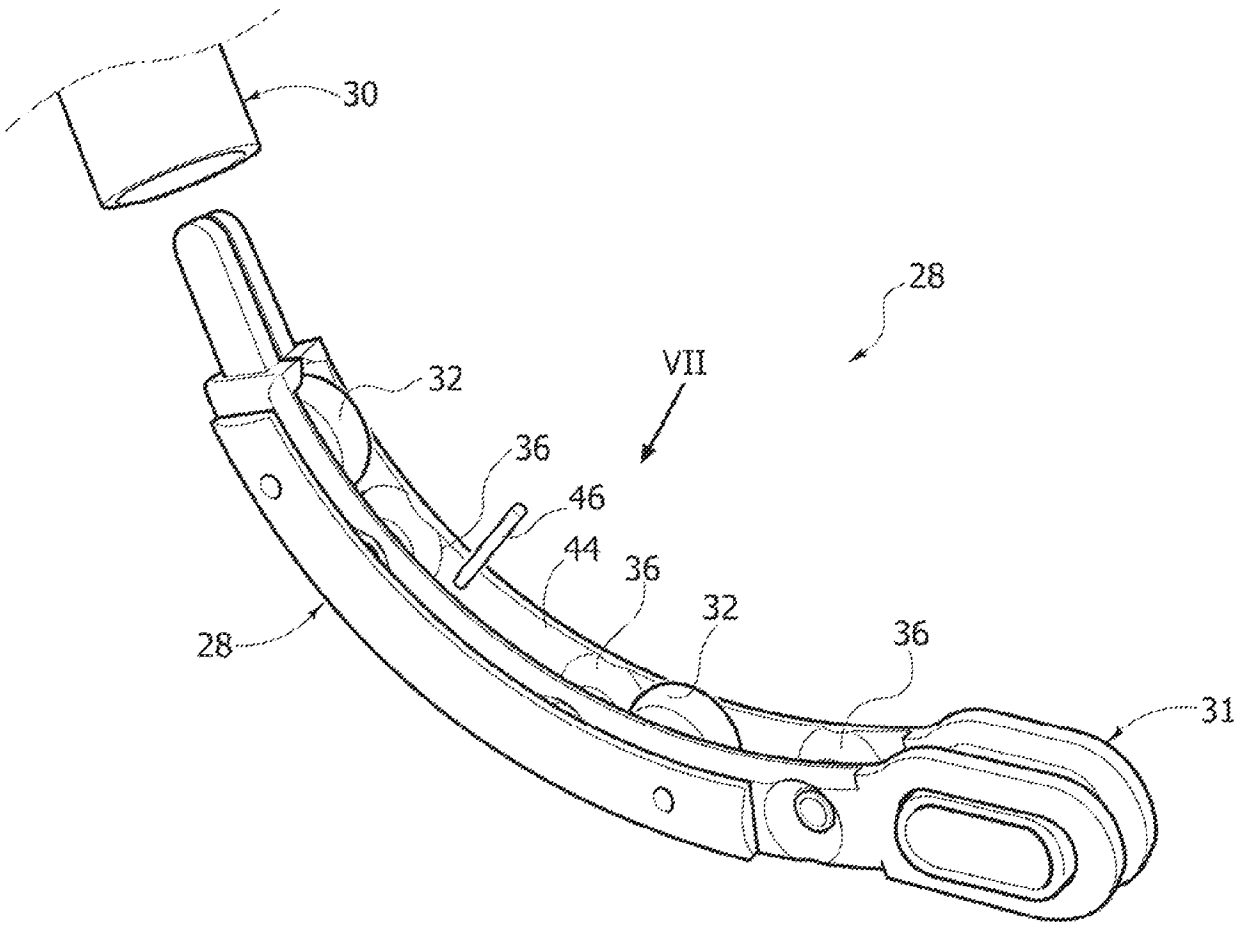
FIG. 6 is a partially exploded perspective view of the oscillation joint of FIG. 5.
Figure 7:
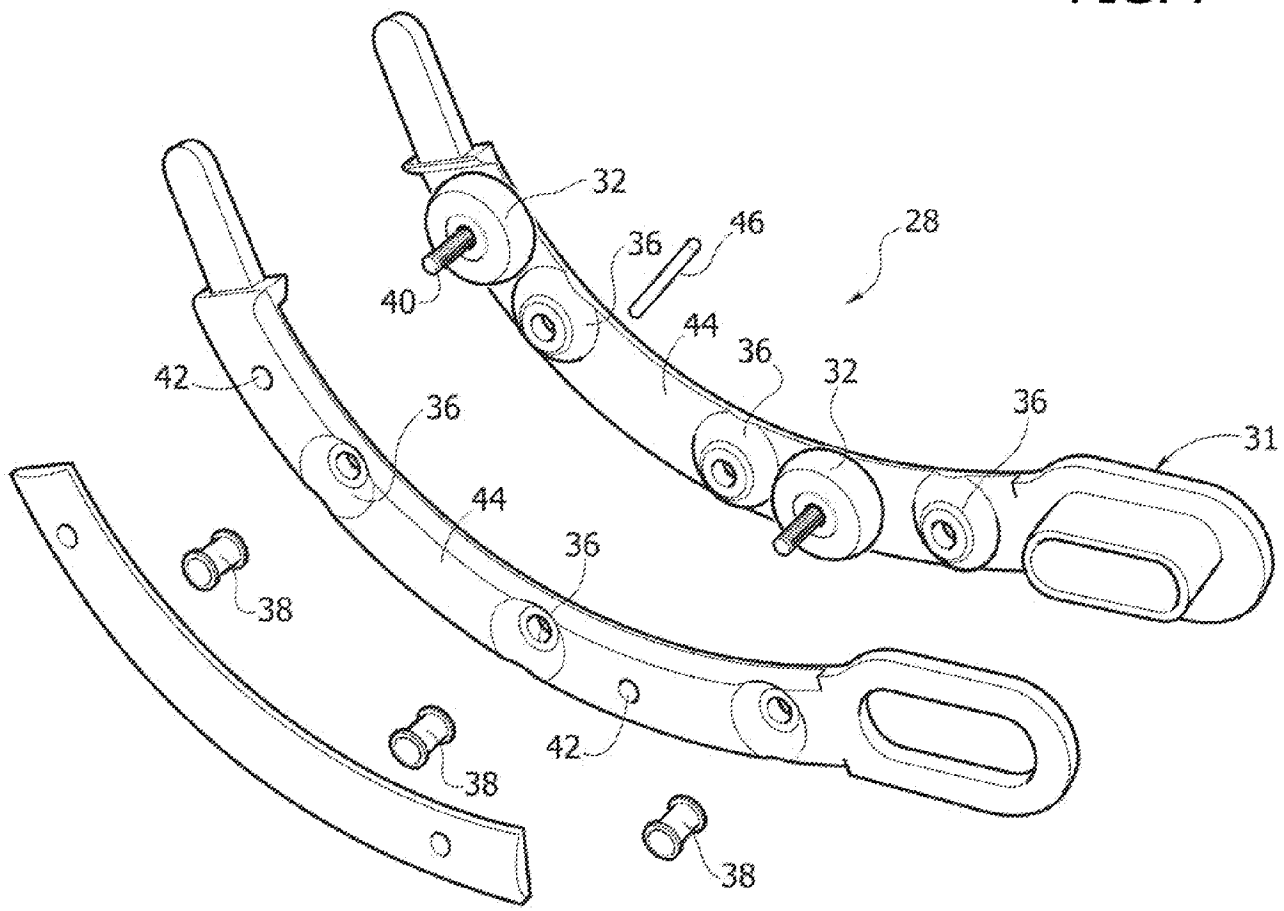
FIG. 7 is an exploded perspective view of the part indicated by the arrow VII in FIG. 6, FIGS. 8 and 9 are axial sections corresponding to FIGS. 3 and 4 illustrating a second embodiment of the oscillation joint according to the invention.

From the constructive point of view, the side joints 26 may be realized in various ways. A first solution envisages a rolling movement between the curved components 28, 30. With reference to FIGS. 6 and 7, the first curved component 28 carries a pair of wheels 32 freely rotatably mounted about their respective axes orthogonal to the longitudinal curved axis A. As shown in FIGS. 3, 4 and 5, the second curved component 30 has a tubular shape with an inner diameter essentially equal to the diameter of the wheels 32. The second curved component 30 can thus move between the positions illustrated in FIGS. 3 and 4 thanks to a rolling contact between the wheels 32 and the inner surface of the second curved component 30.

A particularly simple constructive solution envisages the placing of the wheels 32 between two curved metal profiled bars 34 as illustrated in FIGS. 6 and 7. The metal profiled bars 44 are equipped with studs 36 and are fixed to each other in correspondence to the studs 36 by means of rivets 38. The wheels 32 are rotatably mounted about respective pins 40 whose ends are inserted within holes 42 of the profiled bars 44. The studs 36 act as spacers and create the space for the housing of the wheels 32. Between two adjacent studs 36 a groove 44 is formed into which is inserted a pin 46 fixed to the second curved component 30. The pin 46 and the groove 44 form a limit device that defines the extreme limit positions of the second curved component 30 with respect to the first curved component 28.

With reference to FIGS. 3 to 5, each joint 26 comprises an elastic component that tends to push the backrest 16 towards its rest position. In the example illustrated in the figures, the elastic component is constituted by a helical compression spring 48 disposed between one end of the first curved component 28 and an abutment part 50 fixed inside the second curved component 30. As can be seen from a comparison of FIGS. 3 and 4, the elastic component 48 is compressed during the movement of the second curved component 30 from the rest position to the position of maximum backward tilting. When the backwards push applied by the user's back ceases, the elastic component 48 restitutes the accumulated elastic energy and returns the second curved component 30 to the rest position illustrated in FIG. 3.

Figure 9:
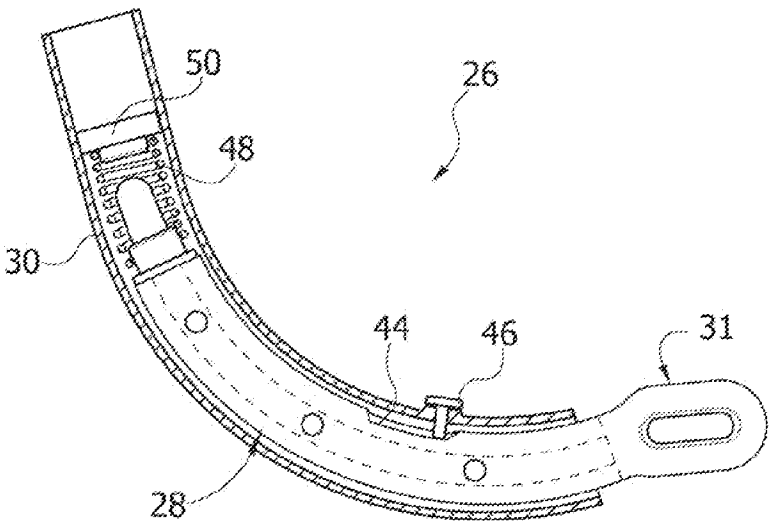
Figure 8:
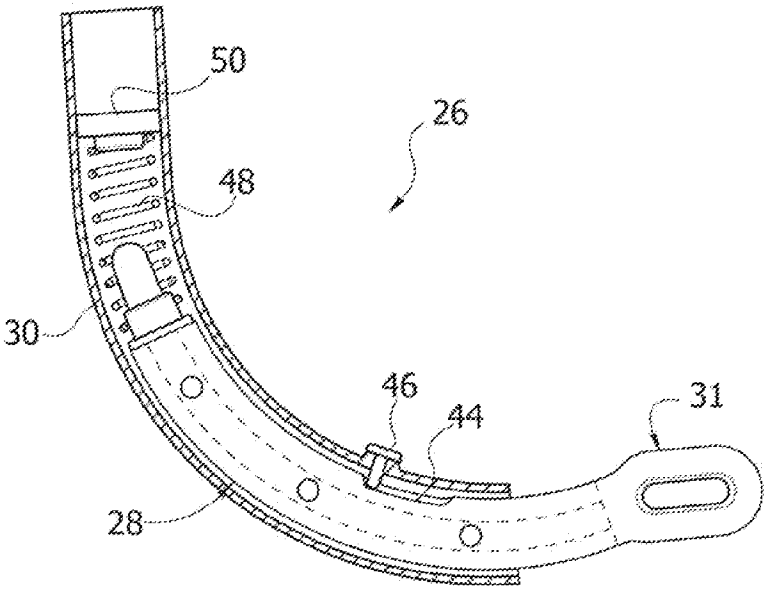
Figure 10:
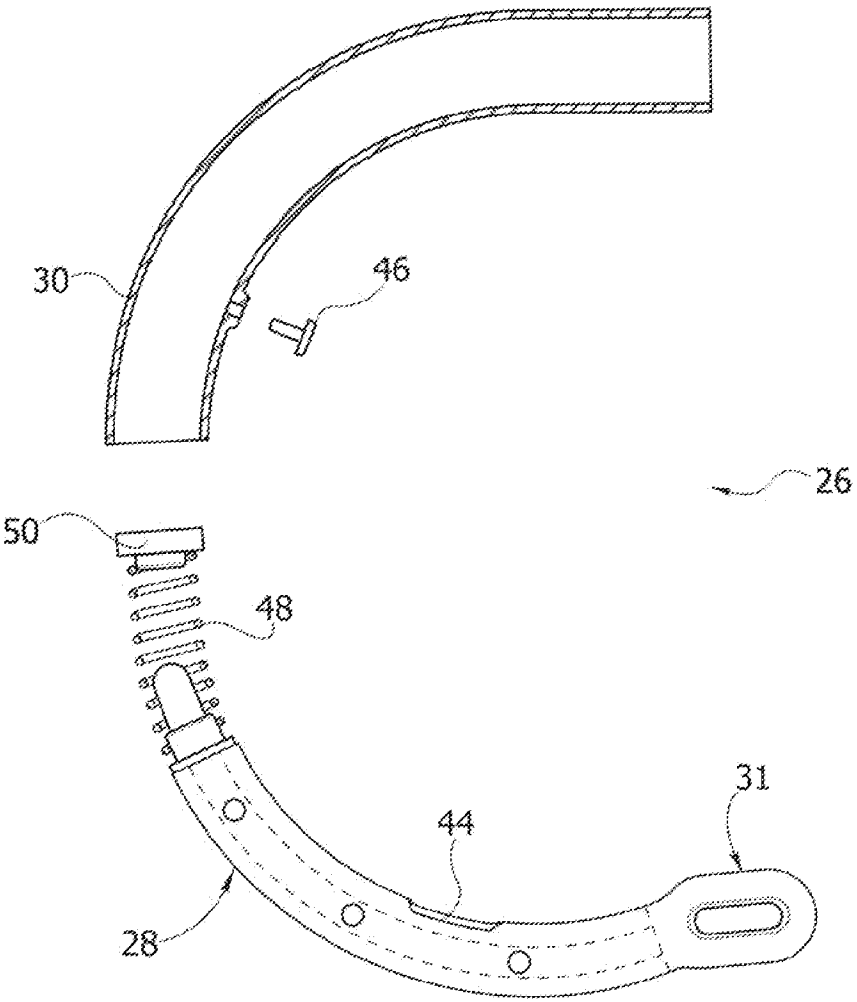
FIG. 10 is an exploded side section of the oscillation joint of FIGS. 8 and 9.

FIGS. 8, 9 and 10 show a variant of the joint 26. In this case, the relative movement between the first and the second curved component 28, 30 takes place by sliding. In particular, the inner wall of the second curved component 30 is coupled to the sliding on a part of the outer surface of the first curved component 28. Strips of material with a low coefficient of friction may be envisaged, such as Teflon or similar material, on friction surfaces in mutual contact.

In this variant the first curved component 28 may be formed from a solid metallic component since there is no need to create the space for the wheels 32. The pin 46 of the limit device engages a groove 44 which may be formed by machining the tool on a surface of the first curved component 28.

Figure 11:
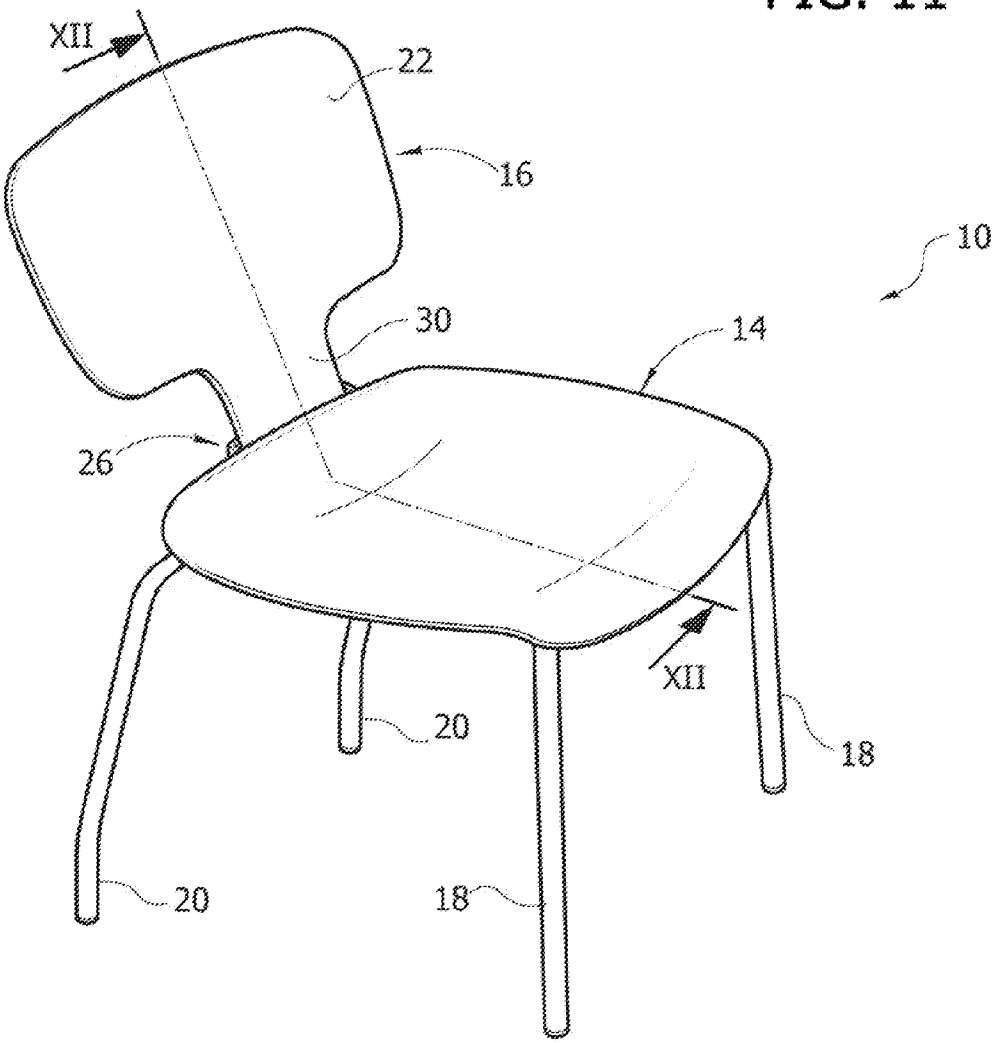
FIG. 11 is a perspective view of a second embodiment of the chair according to the present invention.
Figure 12:
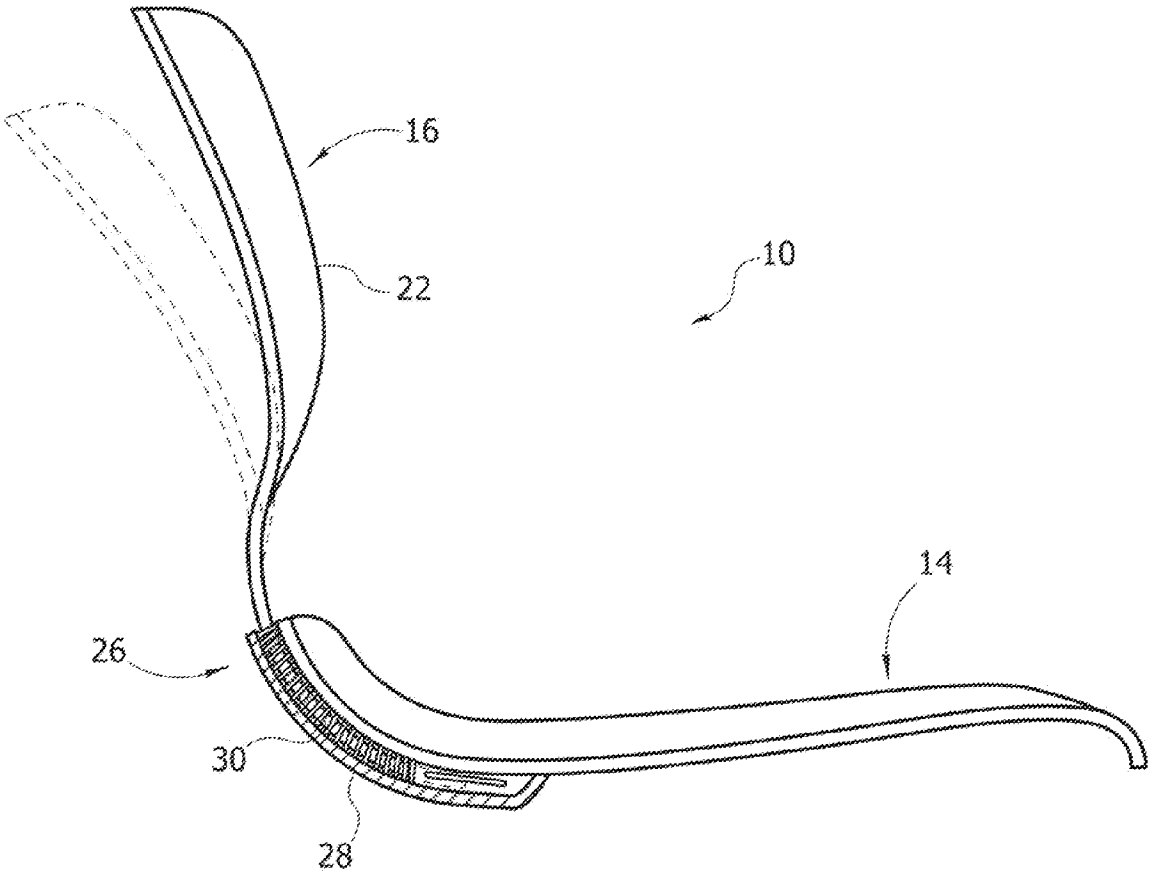
FIG. 12 is a section along line XII-XII of FIG. 11.

FIGS. 11 and 12 illustrate a second embodiment of the chair according to the invention. The components corresponding to those previously described are indicated by the same reference numerals.

In this second embodiment a single joint 26 is envisaged arranged in a central position. The joint 26, as in the embodiment previously described, comprises a first and a second curved component 28, 30 a circular profile, coupled together in a telescopic manner. The curved components 26, 28 are elongated in a transverse direction. The first curved component 28 is fixed to the lower part of the seat 14. The second curved component 30 is fixed or integral to a lower edge of the backrest 16. Also in this case the joint 26 can be fitted with a limit device and an elastic component, as described above. In this case as well, the relative movement between the curved components 28, 30 can take place by means of a rolling contact or sliding.

In FIGS. 13 to 17 a third embodiment of the chair according to the invention is illustrated. The components corresponding to those previously described are indicated using the same reference numerals.

Figure 13:
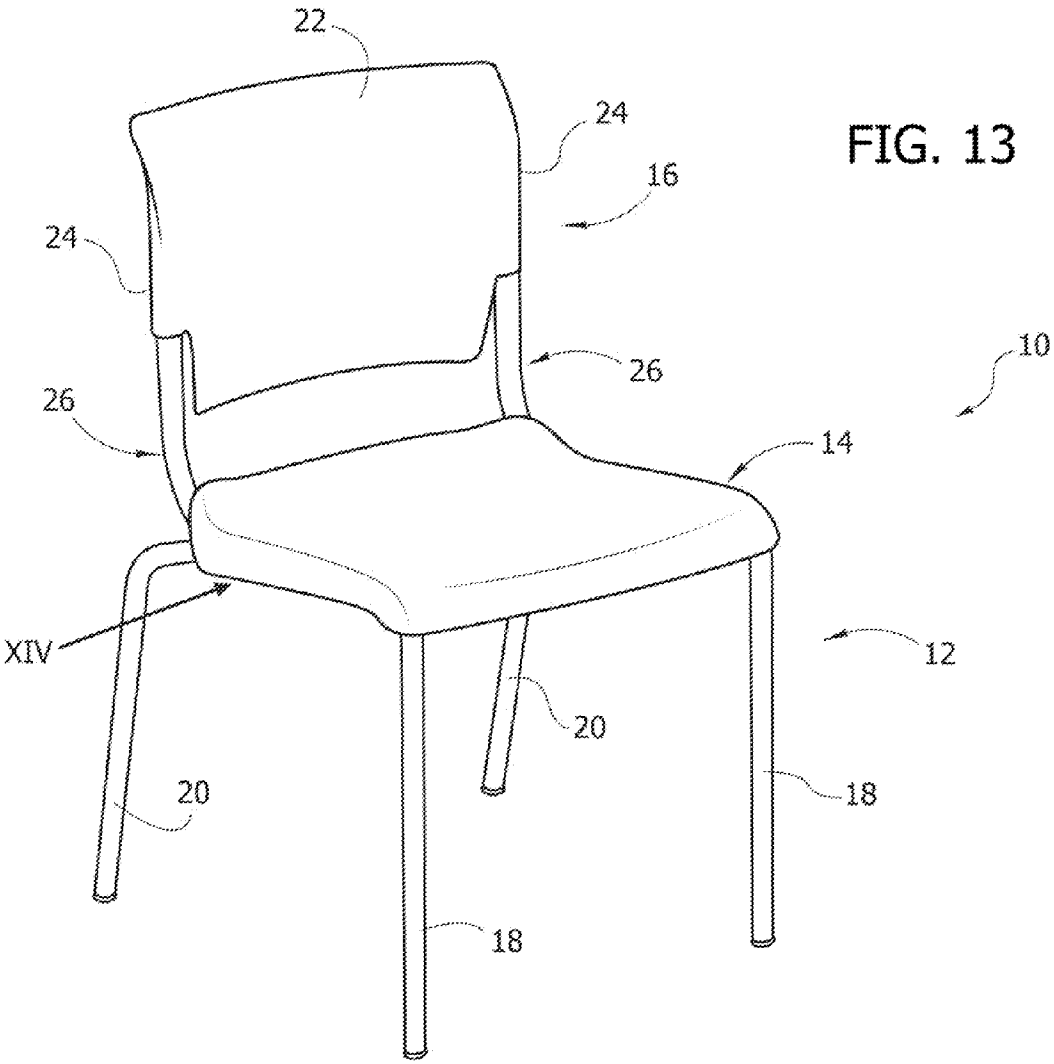
FIG. 13 is a perspective view of a third embodiment of a chair according to the present invention.

As in the case of the chair illustrated in FIG. 1, the chair 10 of FIG. 13 comprises a base structure 12, a seat 14 and a tilting backrest 16. As illustrated in FIGS. 14-17, the base structure 12 comprises two side components 52 from each of which extends a front leg 18 and a rear leg 20. The legs 18, 20 and the side component 52 of each side of the chair are preferably formed from a single bent tubular component. The two side components 52 are fixed together by two transverse components 54, 56.

The backrest 16 comprises a supporting surface 22 and two side uprights of tubular form 24. Preferably, the supporting surface 22 and the side uprights 24 of the backrest 16 are formed by a single component of injection-molded plastic material. The side uprights 24 of the backrest 16 are connected to the base structure 12 by means of respective oscillation joints 26. With reference to FIGS. 14-17, each oscillation joint 26 comprises an inner curved component 28 and an outer curved component 30 coupled together in a telescopic manner. As in the embodiments described above, the two curved components 28, 30 have a common longitudinal axis A in the shape of an arc of a circle. The centres of the arcs of circle A of the two oscillation joints 26 are located on a horizontal axis that defines the tilting axis of the backrest 16.

Figure 16:
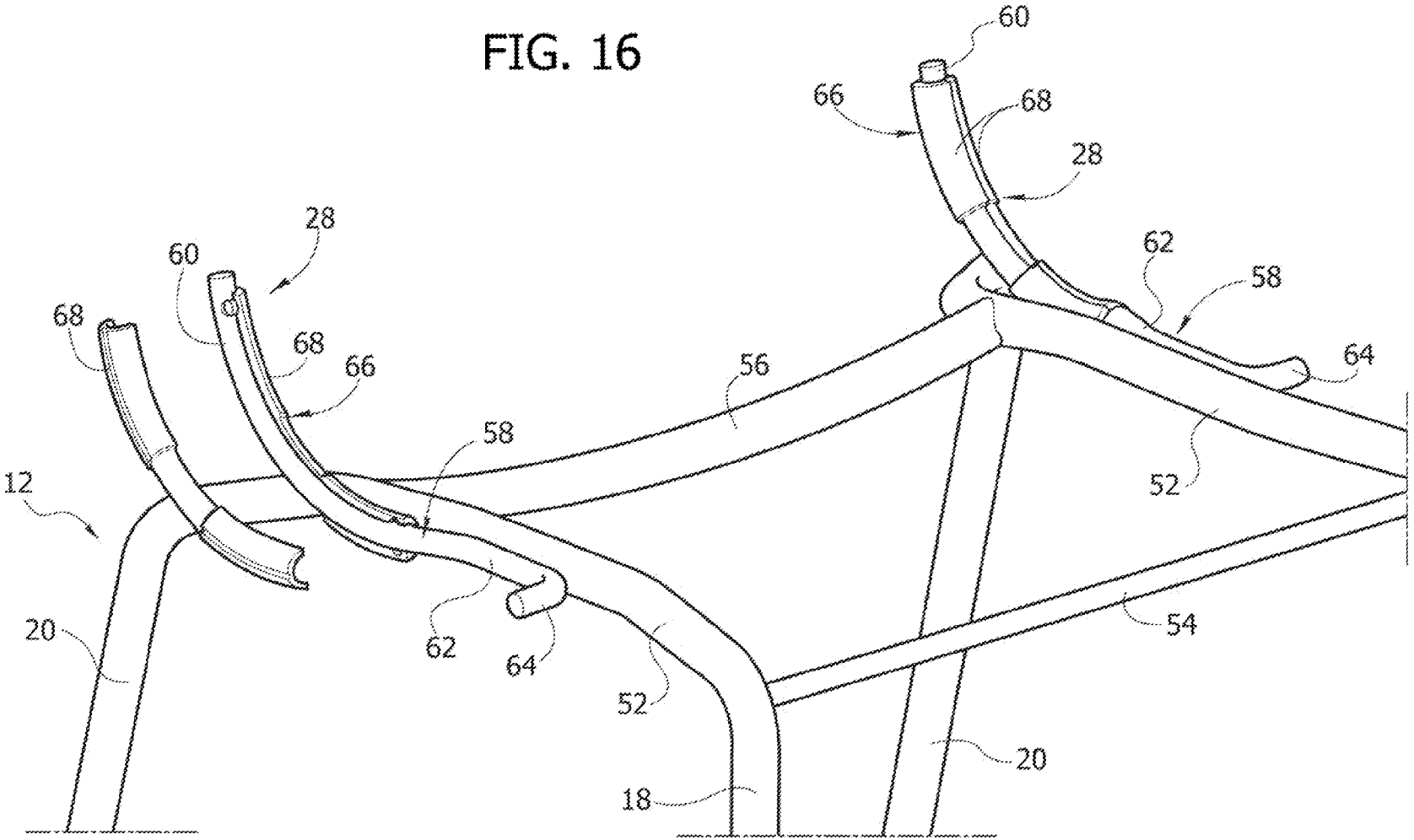
FIGS. 16 and 17 are perspective views corresponding to FIG. 14, with some components of the oscillation joints removed.
Figure 17:
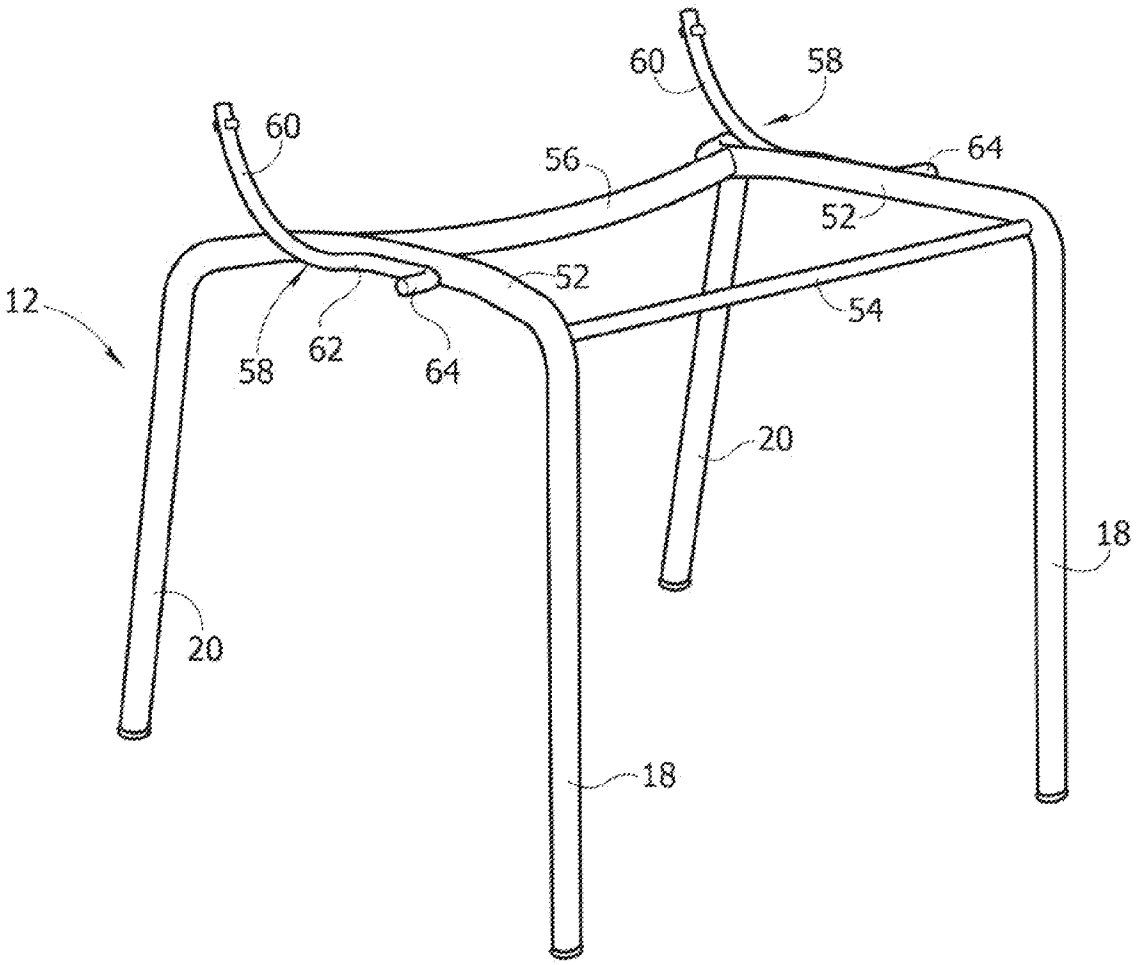

With reference to FIGS. 16 and 17, the inner curved component 28 of each oscillation joint 26 comprises a bent metal bar 58 having an arched portion 60 with a circular profile and a fastening portion 62 fixed to a corresponding side component 52 of the base structure 12. The fastening portion 62 has one end 64 essentially bent in an L-shape.

Each inner curved component 28 further comprises an arched sleeve 66 of plastic material applied on the arched portion 60 of the bent bar 58. As is visible in FIG. 16, the arched sleeve 66 is preferably formed by two arched shells 68 coupled together. The sleeve 66 has a guiding outer surface of circular cross section.

Figure 14:
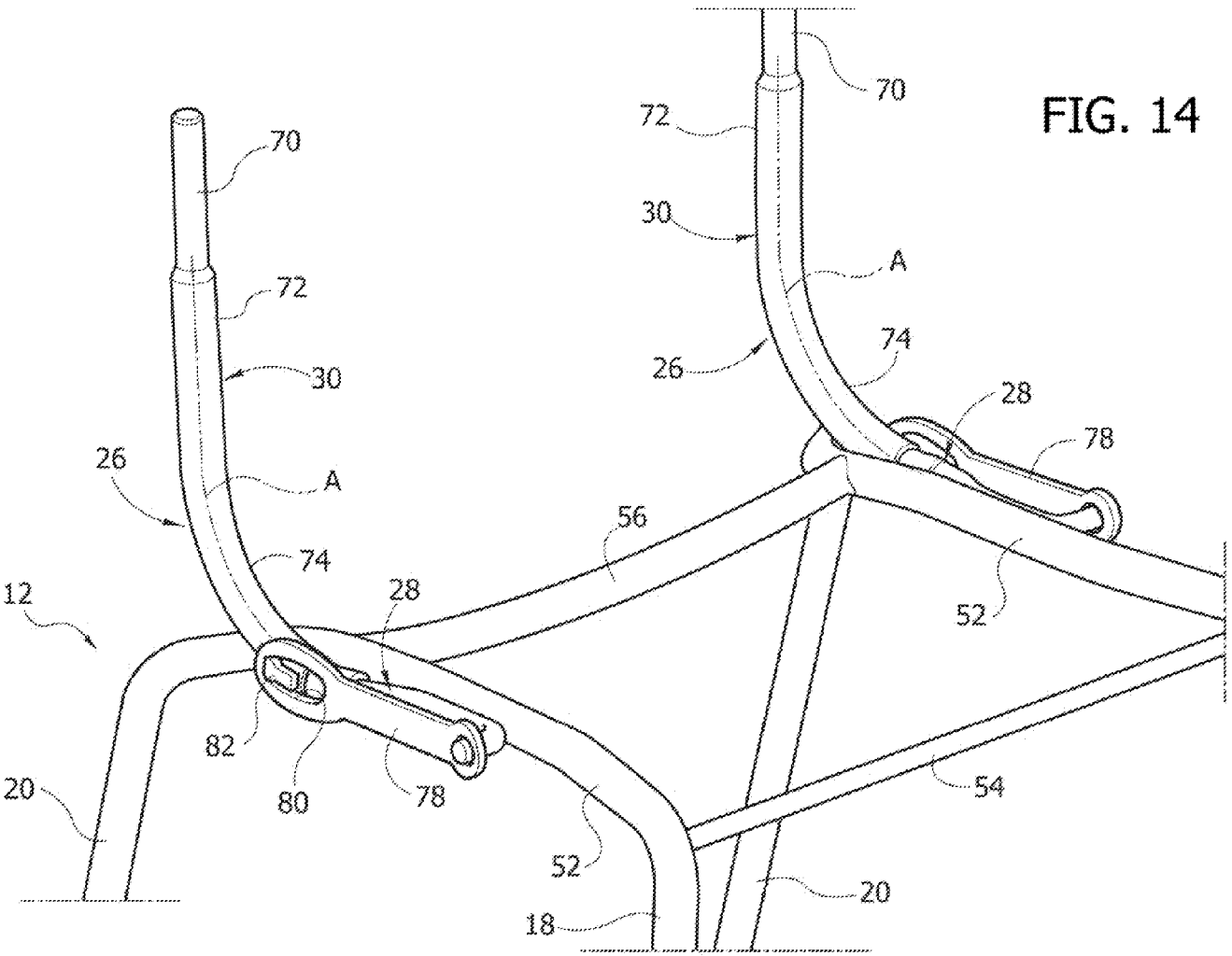
FIG. 14 is a perspective view of the part indicated by the arrow XIV in FIG. 13, with some elements removed for clarity.
Figure 15:
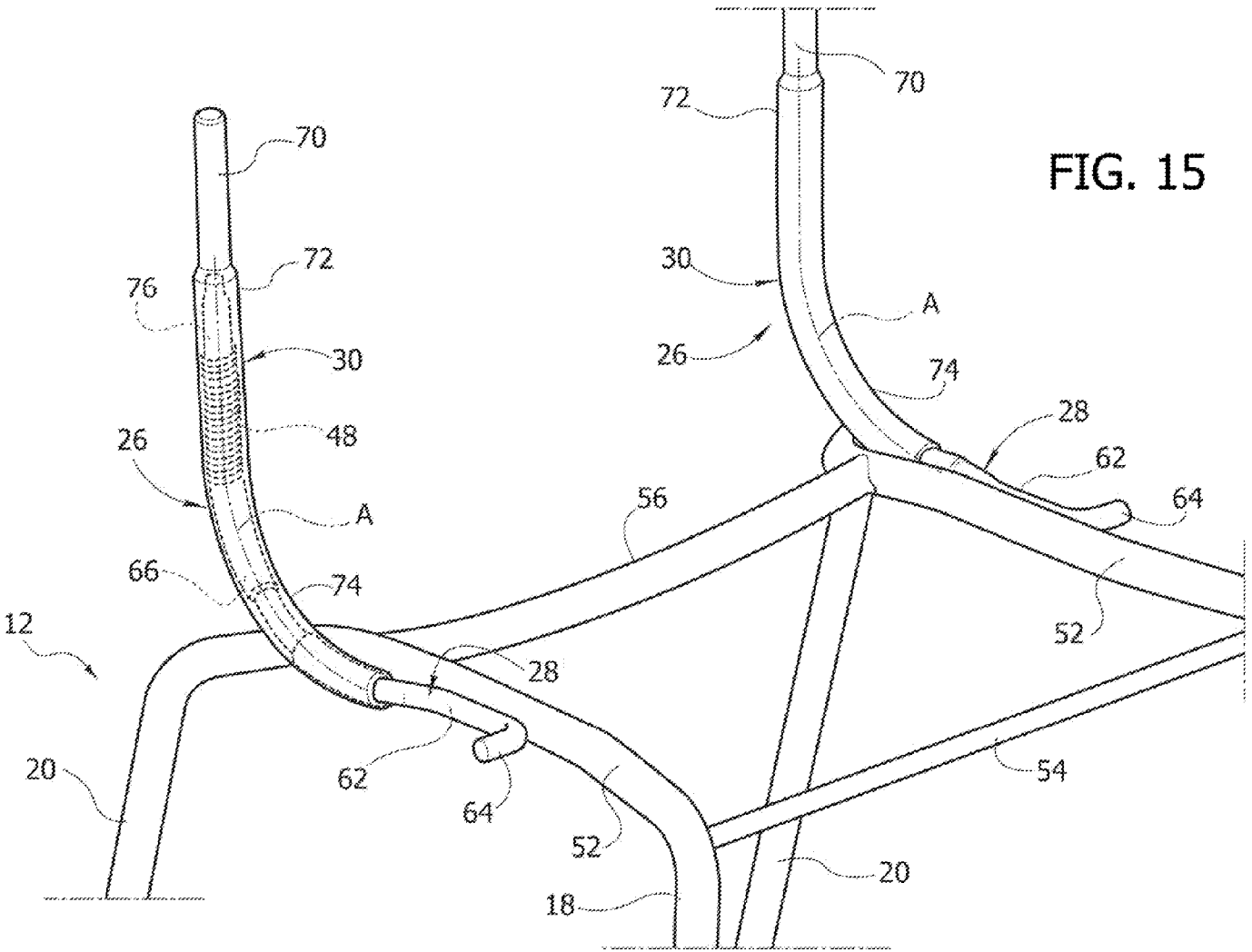
FIG. 15 is a perspective view similar to FIG. 14, with one of the oscillation joints shown in transparency.

With reference to FIGS. 14 and 15, each outer curved component 30 comprises a fastening portion 70, a rectilinear tubular portion 72 which extends from the lower end of the fastening portion 70 and an arched tubular portion 74 which extends from the lower end of the rectilinear tubular portion 72. The fastening portions 70 of the external curved components 30 are inserted and fixed inside the respective side tubular uprights 24 of the backrest 16. The arched tubular portion 74 of each outer curved component 30 has an inner surface of circular cross section which is coupled in a sliding guiding manner with the outer surface of the corresponding arched sleeve 66.

With reference to FIG. 15, within the rectilinear tubular portion 72 of the curved outer component 30 is housed a helical compression spring 48. The spring 48 has an upper end which is inserted on a spring support 76 inserted in the straight tubular portion 72. The lower end of the spring 48 rests against the upper end of the inner curved component 28. Preferably, the spring 48 rests against the upper front end of the arched sleeve 66, and one end of the bent bar 58 which projects beyond the front end of the sleeve 66 is inserted inside the spring 48.

With reference to FIG. 14, each joint 26 is preferably provided with a preload component 78 which, in the rest position of the backrest 16, maintains the outer curved component 30 in a position in which the spring 48 is slightly compressed. The preload component 78 has a first end articulated to the inner curved component 28. Preferably this articulation is formed by a hole of the preload component 78 which engages the L-bent end 64 of the bent bar 58 in a rotatable manner. The preload component 78 has at a second end a slot 80 in which an outer projection 82 of the tubular outer component 30 is engaged. The preload component also acts as an end stop. In fact, in the position of maximum backward tilting of the backrest the protrusion rests against the front end of the slot 80 and prevents further backward tilting movement of the backrest.

Of course, without prejudice to the principle of the invention, the details of construction and the embodiments may be widely varied with respect to what is described and illustrated without thereby departing from the scope of the invention as defined by the claims that follow.

The invention claimed is:

1. A Chair comprising:

a base structure bearing a seat, wherein the base structure comprises two side components from which a front leg and a rear leg extend;

a tilting backrest, wherein the tilting backrest comprises a supporting surface and two tubular uprights connected to the base structure; and a pair of joints, whereby the tilting backrest is connected to the base structure and allows a movement of the tilting backrest between a rest position and a backward tilted position under a backwards push, wherein:

each joint comprises an inner curved component and an outer curved component, the inner curved component and the outer curved component each having circular profiles and coupled together telescopically along a common axis running along a shared centerline of the inner curved component and the outer curved component, the inner curved component and the outer curved component formed into an arc centered on an axis which defines a tilting axis of the tilting backrest;

the inner curved component comprises a bent metal bar forming an arched portion and a fastening portion, the fastening portion fixed to the corresponding side component of the base structure;

the inner curved component further comprises an arched sleeve of plastic material applied on the arched portion of the bent metal bar, the arched sleeve comprising a guiding outer surface of circular cross section; and the outer curved component comprises a fastening portion being inserted and fastened inside the respective tubular uprights of the tilting backrest, a rectilinear tubular portion extending from a lower end of the fastening portion, and an arched portion extending from the rectilinear tubular portion and comprising an inner surface with a circular cross section coupled in a sliding guiding manner with the guiding outer surface of the corresponding arched sleeve.

2. The Chair according to claim 1, further comprising an end stop device comprising a pin fixed to one of the curved components and engaging a groove formed in the other of the curved components.

3. The Chair according to claim 1, further comprising an elastic component under compression disposed between the inner and outer curved components and tending to push the tilting backrest towards the rest position.

4. The Chair according to claim 1, wherein the inner and outer curved components comprise a tubular shape and receives at its interior the other of said curved components.

5. The Chair according to claim 1, wherein relative movement between the inner curved component and the outer curved component occurs by means of a rolling contact.

6. The Chair according to claim 5, wherein one of the curved components carries a plurality of wheels which engage an inner surface of the other curved component with a rolling contact.

7. The Chair according to claim 6, wherein one of the curved components comprises two curved profiles between which are arranged the plurality of wheels.

8. The Chair according to claim 1, wherein relative movement of the inner curved component and the outer curved component occurs by means of a sliding contact.

9. The Chair according to claim 1, further comprising two joints connected to the respective side uprights of the tilting backrest.

10. The Chair according to claim 1, further comprising a single joint disposed in a central position.

11. The Chair according to claim 1, wherein the rectilinear tubular portion of the outer curved component contains a helical compression spring comprising an upper end coupled to a spring support inserted in the rectilinear tubular portion and a lower end which rests against an upper end of the inner curved component.

12. The Chair according to claim 11, wherein each joint is provided with a preload component which, in the rest position of the tilting backrest, retains the outer curved component in a position in which the helical compression spring is slightly compressed, the preload component having a first end articulated to the inner curved component, the preload component having a slot at a second end, in which an outer projection of the outer curved component is engaged, wherein in the position of maximum backward tilting of the tilting backrest the outer projection rests against a front end of the slot and prevents further movement of backward tilting of the tilting backrest.

* * * * *